US007540267B1

(12) United States Patent
Sellars

(10) Patent No.: US 7,540,267 B1
(45) Date of Patent: Jun. 2, 2009

(54) ENGINES WITH VARIABLE VALVE ACTUATION AND VEHICLES INCLUDING THE SAME

(75) Inventor: Daniel Thomas Sellars, West Liberty, OH (US)

(73) Assignee: Honda Motor Company, Ltd., Tokyo (JP)

( * ) Notice: Subject to any disclaimer, the term of this patent is extended or adjusted under 35 U.S.C. 154(b) by 36 days.

(21) Appl. No.: 11/942,851

(22) Filed: Nov. 20, 2007

(51) Int. Cl.
*F01L 1/02* (2006.01)

(52) U.S. Cl. ..... 123/90.31; 123/90.27; 123/90.44; 123/90.6; 29/888.01

(58) Field of Classification Search ..... 123/90.16, 123/90.18, 90.27, 90.31, 90.44, 90.6; 29/888.01, 29/888.08; 74/640, 661
See application file for complete search history.

(56) References Cited

U.S. PATENT DOCUMENTS

| | | | | |
|---|---|---|---|---|
| 3,986,484 | A | 10/1976 | Dyer | |
| 4,726,331 | A | 2/1988 | Oyaizu | |
| 4,744,338 | A | 5/1988 | Sapienza, IV | |
| 4,754,727 | A | 7/1988 | Hampton | |
| 4,771,742 | A | 9/1988 | Nelson et al. | |
| 4,862,845 | A | 9/1989 | Butterfield et al. | |
| 4,878,461 | A | 11/1989 | Sapienza, IV et al. | |
| 4,895,045 | A | 1/1990 | Stidworthy | |
| 4,917,058 | A | 4/1990 | Nelson et al. | |
| 5,002,023 | A | 3/1991 | Butterfield et al. | |
| 5,020,487 | A | 6/1991 | Krüger | |
| 5,113,813 | A | 5/1992 | Rosa | |
| 5,125,372 | A | 6/1992 | Gondek | |
| 5,253,546 | A | 10/1993 | Elrod et al. | |
| 5,417,186 | A | 5/1995 | Elrod et al. | |
| 5,441,021 | A | 8/1995 | Moore, II | |
| 5,671,706 | A | 9/1997 | Frost et al. | |
| 5,860,328 | A | 1/1999 | Regueiro | |
| 5,862,783 | A | 1/1999 | Lewis | |
| 6,216,654 | B1 | 4/2001 | Regueiro | |
| 6,561,145 | B1 | 5/2003 | Stockhausen et al. | |
| 6,591,713 | B2 | 7/2003 | Jesel | |
| 6,832,586 | B2 | 12/2004 | Williams | |
| 7,444,968 | B2 * | 11/2008 | Lancefield et al. | 123/90.17 |

* cited by examiner

*Primary Examiner*—Ching Chang
(74) *Attorney, Agent, or Firm*—Ulmer & Berne LLP

(57) ABSTRACT

An engine includes a camshaft with outer and inner elongate members. The outer elongate member can include a lobe that actuates a valve. The inner elongate member can be axially disposed within a passageway defined by the outer elongate member. The inner elongate member can be movable relative to the outer elongate member. A tab can be attached to the inner elongate member and can extend into an aperture defined by the outer elongate member. Crankshaft and camshaft pulleys can be respectively attached to the crankshaft and camshaft. A flexible transmitter can be routed over the camshaft pulley, a first deflection member, the crankshaft pulley, and a second deflection member. A first deflection actuator can be engaged with the first deflection member and can facilitate variation in a phase relationship between the camshaft and crankshaft pulleys. A vehicle may also be provided.

29 Claims, 7 Drawing Sheets

ENGINES WITH VARIABLE VALVE ACTUATION AND VEHICLES INCLUDING THE SAME

TECHNICAL FIELD

The present invention relates to engines such as for use in vehicles. In particular, the present invention relates to variable actuation of valves in an engine.

BACKGROUND

A camshaft may be provided in an engine to facilitate actuation of valves during engine operation. The camshaft may be engaged with a crankshaft (e.g., via a belt) such that rotation of the crankshaft correspondingly rotates the camshaft to actuate the valves. The mechanical arrangement of the camshaft as well as the phase relationship between the camshaft and the crankshaft may determine various valve actuation characteristics (e.g., the duration of valve actuation, the distance of the actuation of the valve, and the timing of the valve actuation with respect to the crankshaft). Such valve actuation characteristics may affect the operating conditions of the vehicle (e.g., efficiency, reliability, drivability).

SUMMARY OF THE INVENTION

In accordance with one embodiment, an engine comprises a crankshaft, a crankshaft pulley, a piston cylinder, a piston, a valve, a camshaft, a camshaft pulley, a first deflection member, a second deflection member, a flexible transmitter, and a first deflection actuator. The crankshaft pulley is attached to the crankshaft and is configured to rotate about a crankshaft axis. The piston is attached to the crankshaft and is disposed at least partially within the piston cylinder. The valve is configured for selectively facilitating passage of fluid with respect to the piston cylinder. The camshaft comprises an outer elongate member, an inner elongate member, a tab, and a camshaft actuator. The outer elongate member comprises an outer surface and a lobe. The lobe is configured for actuating the valve. The outer elongate member axially defines a passageway and defines an aperture extending from the outer surface to the passageway. The outer elongate member is configured to rotate about a first axis. The inner elongate member is axially disposed within the passageway and is configured to move within the passageway. The tab is attached to the inner elongate member and extends into the aperture defined by the outer elongate member. The camshaft actuator is configured to selectively move the inner elongate member relative to the outer elongate member. The camshaft pulley is attached to the camshaft and is configured to rotate about the first axis. The flexible transmitter is routed sequentially over the camshaft pulley, the first deflection member, the crankshaft pulley, and the second deflection member. Rotation of the crankshaft correspondingly rotates the camshaft pulley to facilitate a phase relationship between the camshaft pulley and the crankshaft pulley. The first deflection actuator is engaged with the first deflection member and is configured to selectively adjust the relative distance between the first deflection member and the crankshaft axis to facilitate variation in the phase relationship.

In accordance with another embodiment, an engine comprises a crankshaft, a crankshaft pulley, at least one piston cylinder, at least one piston, a plurality of valves, a first camshaft, a second camshaft, a first camshaft pulley, a second camshaft pulley, a first deflection member, a second deflection member, a flexible transmitter, and a first deflection actuator. The crankshaft pulley is attached to the crankshaft and is configured to rotate about a crankshaft axis. The at least one piston is attached to the crankshaft and is disposed at least partially within the piston cylinder. The plurality of valves are configured for selectively facilitating passage of fluid with respect to said piston cylinder. The first camshaft comprises a first outer elongate member, a first inner elongate member, a first tab, and a first camshaft actuator. The first outer elongate member comprises a first outer surface and a first lobe. The first lobe is configured for actuating one of said valves. The first outer elongate member axially defines a first passageway and defines a first aperture extending from the first outer surface to the first passageway. The first outer elongate member is configured to rotate about a first axis. The first inner elongate member is axially disposed within the first passageway and is configured to move within the first passageway. The first tab is attached to the first inner elongate member and extends into the first aperture defined by the first outer elongate member. The first camshaft actuator is configured to selectively move the first inner elongate member relative to the first outer elongate member. The second camshaft comprises a second outer elongate member, a second inner elongate member, a second tab, and a second camshaft actuator. The second outer elongate member comprises a second outer surface and a second lobe. The second lobe is configured for actuating another of said valves. The second outer elongate member axially defines a second passageway and defines a second aperture extending from the second outer surface to the second passageway. The second outer elongate member is configured to rotate about a second axis. The second inner elongate member is axially disposed within the second passageway and is configured to move within the second passageway. The second tab is attached to the second inner elongate member and extends into the second aperture defined by the second outer elongate member. The second camshaft actuator is configured to selectively move the second inner elongate member relative to the second outer elongate member. The first camshaft pulley is attached to the first camshaft and is configured to rotate about the first axis. The second camshaft pulley is attached to the second camshaft and is configured to rotate about the second axis. The flexible transmitter is routed over the first camshaft pulley, the second camshaft pulley, the first deflection member, the second deflection member, and the crankshaft pulley. Rotation of the crankshaft correspondingly rotates the first camshaft pulley and the second camshaft pulley to facilitate a phase relationship between each of the first camshaft pulley, the second camshaft pulley, and the crankshaft pulley. The deflection actuator is engaged with the first deflection member and is configured to selectively adjust the relative distance between the first deflection member and the crankshaft axis to facilitate variation in the phase relationship between at least two of the first camshaft pulley, the second camshaft pulley, and the crankshaft pulley.

In accordance with another embodiment, a vehicle comprises a drivetrain and an engine coupled to the drivetrain. The engine comprises a crankshaft, a crankshaft pulley, a piston cylinder, a piston, a valve, a camshaft, a camshaft pulley, a first deflection member, a second deflection member, a flexible transmitter, and a first deflection actuator. The crankshaft pulley is attached to the crankshaft and is configured to rotate about a crankshaft axis. The piston is attached to the crankshaft and is disposed at least partially within the piston cylinder. The valve is configured for selectively facilitating passage of fluid with respect to the piston cylinder. The camshaft comprises an outer elongate member, an inner elongate member, a tab, and a camshaft actuator. The outer elongate member comprises an outer surface and a lobe. The lobe is configured for actuating the valve. The outer elongate member axially defines a passageway and defines an aperture extending from the outer surface to the passageway. The outer elongate member is configured to rotate about a first axis. The inner elongate member is axially disposed within the passageway and is configured to move within the passageway. The tab is attached to the inner elongate member and extends into the aperture defined by the outer elongate member. The camshaft actuator is configured to selectively move the inner elongate member relative to the outer elongate member. The camshaft pulley is attached to the camshaft and is configured to rotate about the first axis. The flexible transmitter is routed sequentially over the camshaft pulley, the first deflection member, the crankshaft pulley, and the second deflection member. Rotation of the crankshaft correspondingly rotates the camshaft pulley to facilitate a phase relationship between the camshaft pulley and the crankshaft pulley. The first deflection actuator is engaged with the first deflection member and is configured to selectively adjust the relative distance between the first deflection member and the crankshaft axis to facilitate variation in the phase relationship.

In accordance with another embodiment, a vehicle comprises a drivetrain and an engine coupled with the drivetrain. The engine comprises a crankshaft, a crankshaft pulley, at least one piston cylinder, at least one piston, a plurality of valves, a first camshaft, a second camshaft, a first camshaft pulley, a second camshaft pulley, a first deflection member, a second deflection member, a flexible transmitter, and a first deflection actuator. The crankshaft pulley is attached to the crankshaft and is configured to rotate about a crankshaft axis. The at least one piston is attached to the crankshaft and is disposed at least partially within the piston cylinder. The plurality of valves are configured for selectively facilitating passage of fluid with respect to said piston cylinder. The first camshaft comprises a first outer elongate member, a first inner elongate member, a first tab, and a first camshaft actuator. The first outer elongate member comprises a first outer surface and a first lobe. The first lobe is configured for actuating one of said valves. The first outer elongate member axially defines a first passageway and defines a first aperture extending from the first outer surface to the first passageway. The first outer elongate member is configured to rotate about a first axis. The first inner elongate member is axially disposed within the first passageway and is configured to move within the first passageway. The first tab is attached to the first inner elongate member and extends into the first aperture defined by the first outer elongate member. The first camshaft actuator is configured to selectively move the first inner elongate member relative to the first outer elongate member. The second camshaft comprises a second outer elongate member, a second inner elongate member, a second tab, and a second camshaft actuator. The second outer elongate member comprises a second outer surface and a second lobe. The second lobe is configured for actuating another of said valves. The second outer elongate member axially defines a second passageway and defines a second aperture extending from the second outer surface to the second passageway. The second outer elongate member is configured to rotate about a second axis. The second inner elongate member is axially disposed within the second passageway and is configured to move within the second passageway. The second tab is attached to the second inner elongate member and extends into the second aperture defined by the second outer elongate member. The second camshaft actuator is configured to selectively move the second inner elongate member relative to the second outer elongate member. The first camshaft pulley is attached to the first camshaft and is configured to rotate about the first axis. The second camshaft pulley is attached to the second camshaft and is configured to rotate about the second axis. The flexible transmitter is routed over the first camshaft pulley, the second camshaft pulley, the first deflection member, the second deflection member, and the crankshaft pulley. Rotation of the crankshaft correspondingly rotates the first camshaft pulley and the second camshaft pulley to facilitate a phase relationship between each of the first camshaft pulley, the second camshaft pulley, and the crankshaft pulley. The first deflection actuator is engaged with the first deflection member and is configured to selectively adjust the relative distance between the first deflection member and the crankshaft axis to facilitate variation in the phase relationship between at least two of the first camshaft pulley, the second camshaft pulley and the crankshaft pulley.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 10:
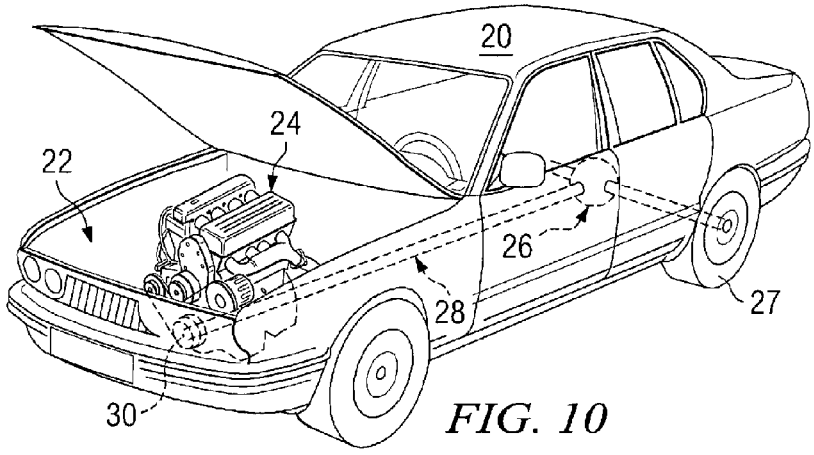
FIG. 10 is a front perspective view depicting a vehicle including the engine of FIG. 1.

The present invention and its operation are hereinafter described in detail in connection with the views and examples of FIGS. 1-10, wherein like numbers indicate the same or corresponding elements throughout the views. An engine in accordance with one embodiment can be provided in a vehicle such as, for example, an automobile, a recreational vehicle, a utility vehicle, a water craft, or a toy. In one embodiment, and as depicted in FIG. 10, an engine 24 may be provided in an engine compartment 22 of an automobile 20. The automobile 20 may comprise a drivetrain 26 coupled to wheels (e.g., 27). The drivetrain 26 may be coupled to the engine 24 such that power from the engine 24 may be transmitted through the drivetrain 26 to the wheels 27 to propel the automobile 20.

Figure 1:
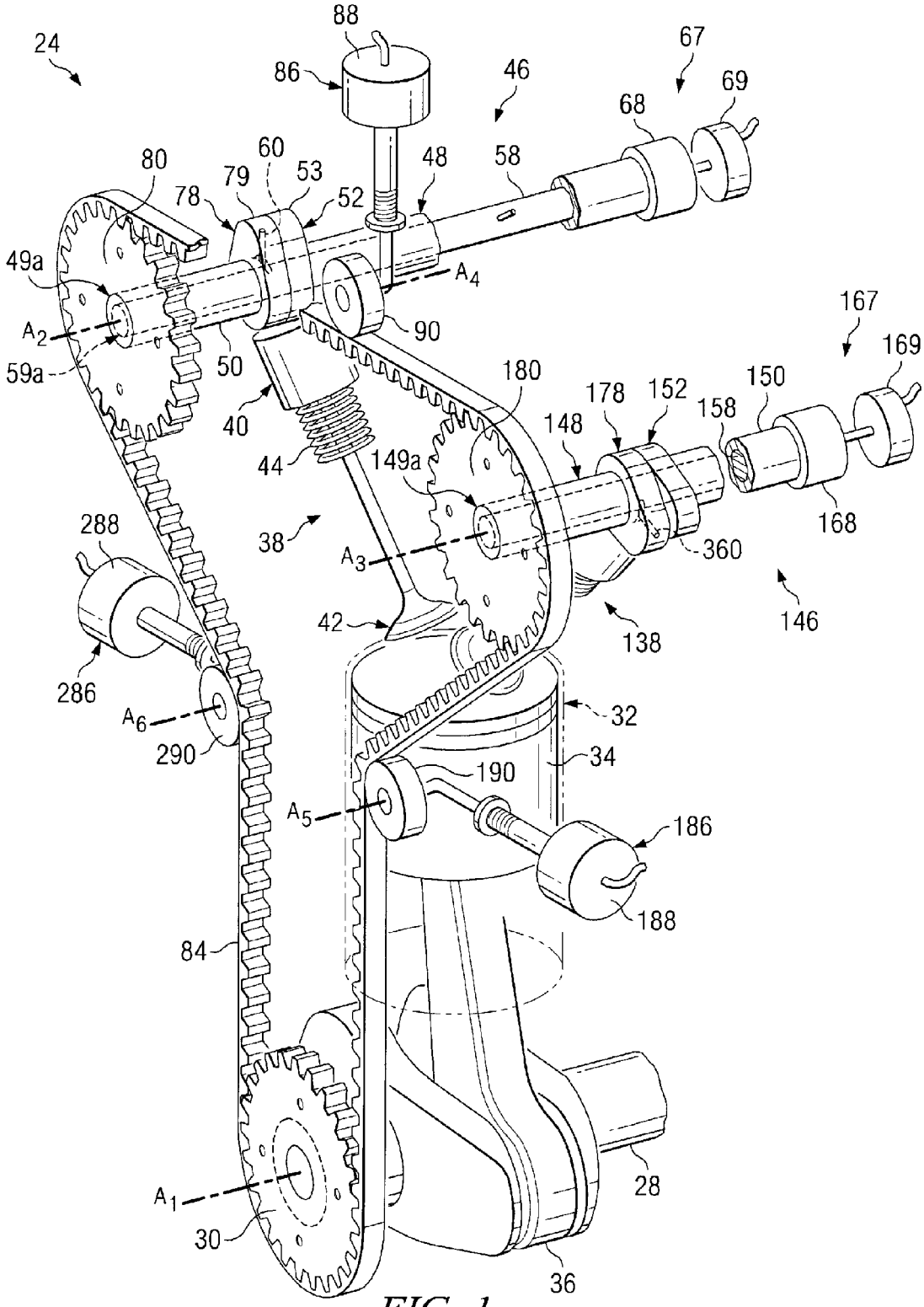
FIG. 1 is a perspective view depicting various components of an engine in accordance with one embodiment.

Referring now to FIG. 1, the engine 24 may comprise a crankshaft 28, a crankshaft pulley (e.g., sprocket 30), a piston cylinder 32, a piston 34, and a connecting rod 36. The piston 34 may be disposed at least partially within the piston cylinder 32 and attached to the connecting rod 36. The connecting rod 36 may be pivotally coupled to a portion of the crankshaft 28 such that movement of the piston 34 within the piston cylinder 32 correspondingly rotates the crankshaft 28. One end of the crankshaft 28 may be coupled to the crankshaft pulley while another end of the crankshaft 28 may be coupled to the drivetrain 26. Rotation of the crankshaft 28 may correspondingly rotate the crankshaft pulley about an axis $A_1$. The engine 24 in FIG. 1 is shown and described herein with respect to piston cylinder 32 and piston 34. However, it will be appreciated that the engine may comprise additional piston cylinders and pistons in any of a variety of configurations or arrangements (e.g., inline four cylinder, V-6, V-8, flat-6).

As is common, fluid (e.g., gasoline, diesel fuel, propane) may be provided to the piston cylinder 32 and ignited (e.g., by a spark plug or via compression) to actuate the piston 34. Subsequent to such ignition, exhaust fluid may remain in the piston cylinder 32. To facilitate passage of fluid with respect to the piston cylinder 32, the engine 24 may further comprise one or more valves (e.g., 38, 138) which are movably disposed adjacent to the piston cylinder 32. For example, the valve 38 may be movable between a closed position and an extended position. In the closed position, the valve 38 may seal the piston cylinder 32 such that the fluid may be contained within the piston cylinder 32 (i.e., for ignition). In an extended position, the valve 38 may open the piston cylinder 32 such that fluid may pass into or out of the piston cylinder 32. The valve 38 may comprise a first end portion 40, a second end portion 42, and a valve spring 44. The second end portion 42 of the valve 38 may be shaped similarly to an aperture defined by the piston cylinder 32 (not shown) such that the piston cylinder 32 is sealed when the second end portion 42 is in contact with the piston cylinder 32. The valve spring 44 may be attached to the valve 38 to bias the valve 38 into the closed position.

In one embodiment, the first end portion 40 of the valve 38 may comprise a planar portion. In such an embodiment, a camshaft (as described in detail below) may contact the first end portion 40 of the valve 38 to actuate the valve 38 between the closed position and an extended position. In another embodiment, the first end portion of the valve may comprise a cam follower. In yet another embodiment, the first end portion of the valve may comprise a hinged portion. In such an embodiment, an elongate member (e.g., a pushrod) may be hingedly attached to the first end portion of the valve to actuate the valve between the closed position and an extended position. It will be appreciated that a valve may be provided in any of a variety of suitable alternative configurations or arrangements for facilitating the passage of fluid with respect to a piston cylinder.

It will also be appreciated that an engine can include one or more valves, wherein each of the valves can, in one embodiment, be similar to the valve described above. In one embodiment and as illustrated in FIG. 1, the engine 24 is shown to comprise two valves 38 and 138. The two valves 38, 138 may be movably disposed adjacent to the piston cylinder 32 and adjacent to each other. In such an embodiment, one valve (e.g., 38) may comprise an intake valve that facilitates the passage of fluid into the piston cylinder 32. In the same embodiment, the other valve (e.g., 138) may comprise an exhaust valve that facilitates the passage of fluid out of the piston cylinder 32. In alternative embodiments, a particular piston cylinder may comprise any number of valves to facilitate the passage of fluid with respect to the piston cylinder.

The engine 24 may comprise camshafts 46 and 146 which may respectively actuate the valves 38 and 138. The camshaft 46 may comprise an outer elongate member 48. In one embodiment, the outer elongate member 48 may be rotatably supported by the engine 24 with rotatable supports (e.g., bearings). In another embodiment, the outer elongate member 48 may be rotatably supported by the engine via a housing wherein viscous fluid is provided between the outer elongate member and the housing. However, it will be appreciated that the outer elongate member may be rotatably supported in any of a variety of configurations or arrangements.

Figure 3:
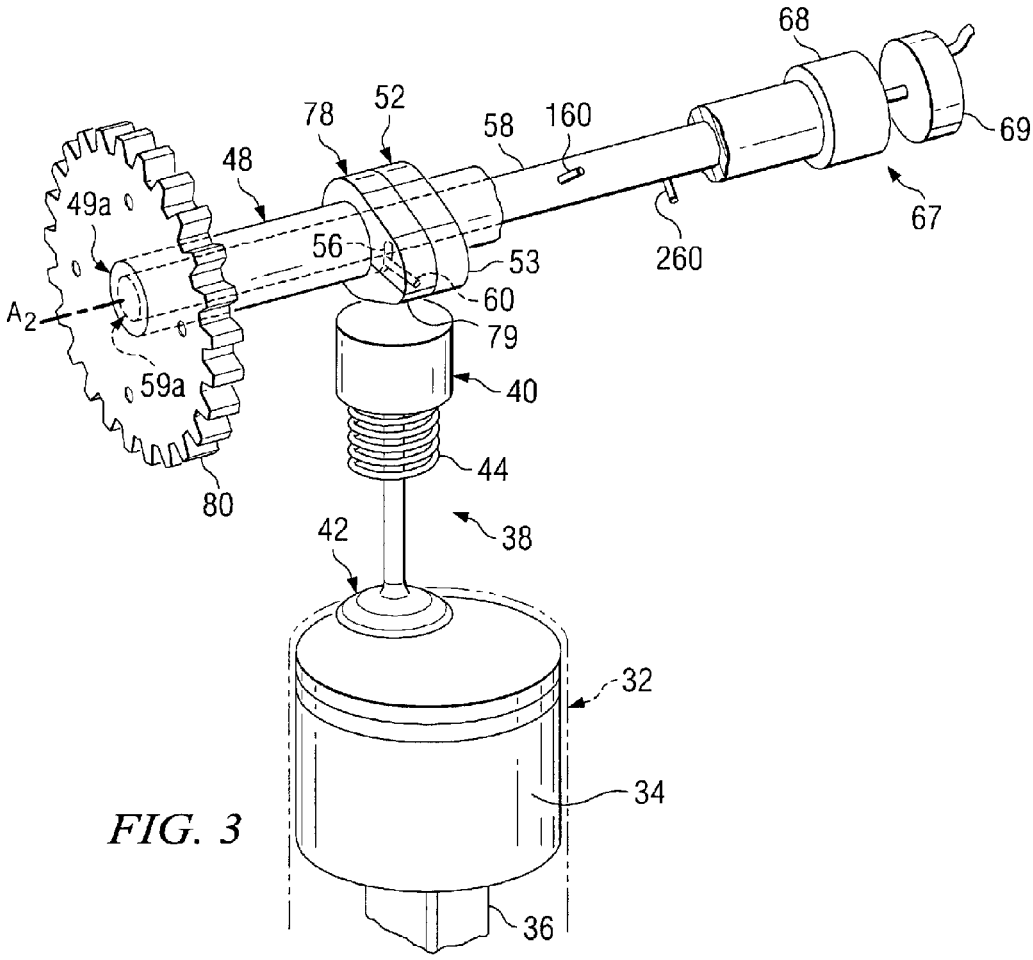
FIG. 3 is a perspective view depicting a piston, a piston chamber, a valve, and a camshaft of the engine of FIG. 1 wherein a second cam is aligned with a first cam.
Figure 4:
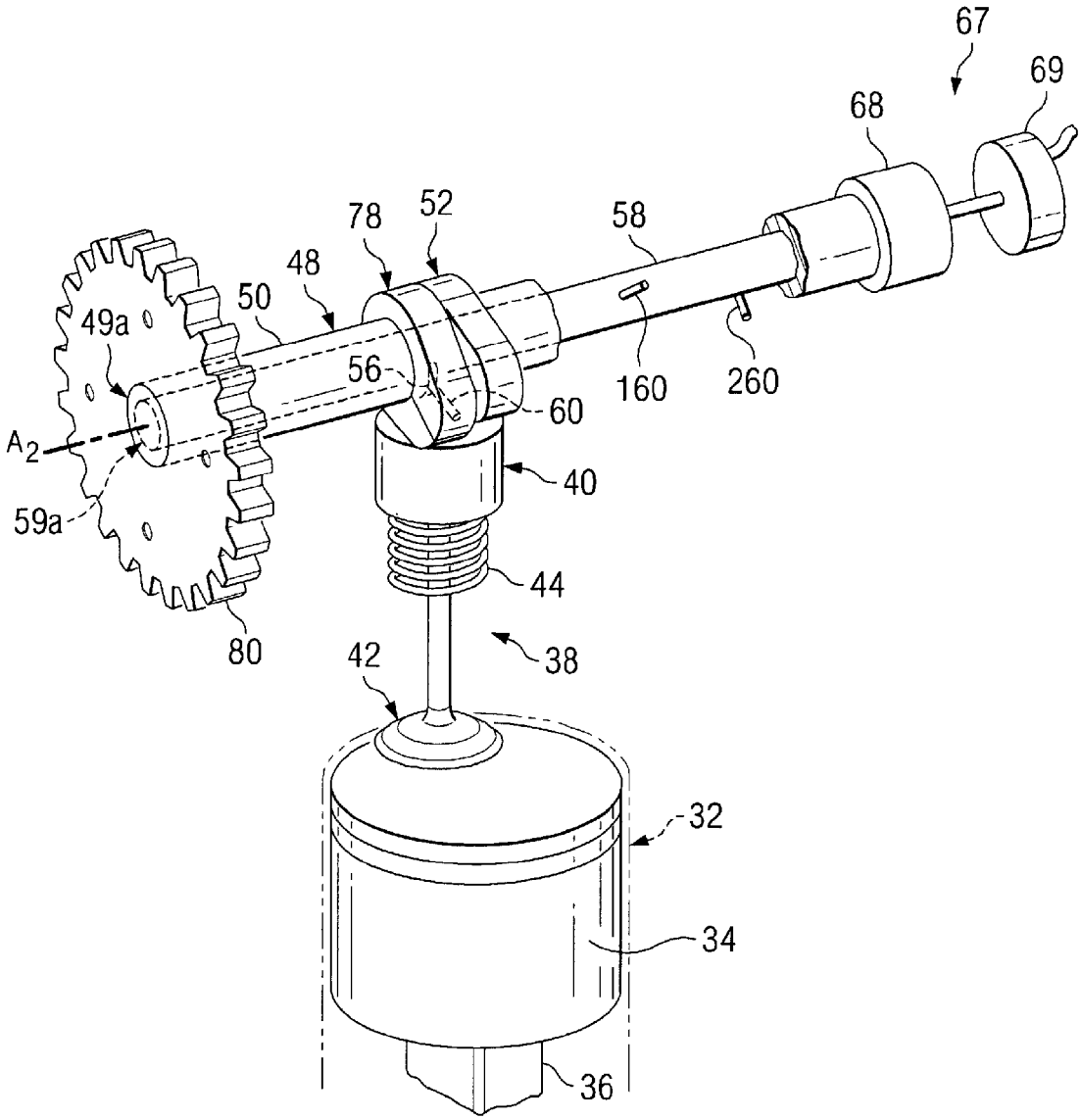
FIG. 4 is a perspective view depicting the components of FIG. 3 wherein the second cam is pivoted with respect to the first cam.

The outer elongate member 48 may be provided such that the outer elongate member 48 contacts the valve 38. For example, the outer elongate member 48 is shown in FIGS. 1, 3 and 4 to be substantially adjacent to the valve 38 and to be rotatable about an axis $A_2$. In one embodiment, as shown in FIGS. 1, 3 and 4, the outer elongate member 48 may comprise a lobe which contacts the valve 38. The lobe may correspondingly rotate with the outer elongate member 48 to actuate the valve 38 between the closed position and an extended position. In one embodiment, the lobe comprises a first cam 52 and a second cam 78 which may each be positioned to continuously or selectively contact the first end portion 40 of the valve 38. As the outer elongate member 48 rotates about the axis $A_2$, the shape of the first and second cams 52, 78 may facilitate actuation of the valve 38 between the closed position and an extended position.

It will be appreciated that the outer elongate member 48 may contact the valves directly or indirectly. In one embodiment and as illustrated in FIGS. 1, 3 and 4, the camshaft 46 may be provided adjacent to the valve 38 such that the first end portion 40 of the valve 38 directly contacts the surfaces of the first and second cams 52, 78. During rotation of the outer elongate member 48 about the axis $A_2$, the surfaces of the first and second cams 52, 78 can continually actuate the valve 38 between the closed position and an extended position. In another embodiment, the camshaft may be provided apart from the valve such that the first end portion of the valve indirectly contacts the lobe. In such an embodiment, a pushrod can be provided between the lobe and the first end portion of the valve. In this configuration, during rotation of the outer elongate member, the lobe actuates the pushrod which correspondingly actuates the valve between the closed position and an extended position. It will be appreciated that the lobe may be arranged in any of a variety of suitable configurations.

As shown in FIGS. 1 and 3-5, the first cam 52 may comprise a peak portion 53 and the second cam 78 may comprise a peak portion 79. It will be appreciated that the shape of the lobe may provide particular valve activation characteristics (e.g., the duration that the valve remains in the closed position, the duration that the valve remains in the extended position, the distance that the valve is actuated). Selection of different lobe configurations (i.e., valve actuation characteristics) may affect the operation of the engine (e.g., efficiency, smoothness). For example, the height of the peak portions 53, 79 may affect the distance that the valve 38 is actuated. In another example, the width of the peak portions 53, 79 may affect the duration the valve 38 remains in an extended position.

The camshaft 46 may comprise an inner elongate member 58. The inner elongate member 58 may extend between a first end portion 59*a* and a second end portion 59*b* (shown in FIG. 5). The inner elongate member 58 may be disposed within a passageway 54 defined by the outer elongate member 48 and may be movable with respect to the outer elongate member 48. In one embodiment, the inner elongate member 58 may be pivotable with respect to the outer elongate member 48 about the axis $A_2$. In such an embodiment, the first end portion 59*a* and the second end portion 59*b* may be supported by rotatable members (e.g., bearings) within the passageway 54. In another embodiment, the inner elongate member may be slidable with respect to the outer elongate member. In such an embodiment, a viscous fluid may be provided between the inner and outer elongate members such that the inner elongate member is slidable along the axis $A_2$. It will be appreciated that the inner elongate member may be movable in any of a variety of alternative configurations or arrangements. It will also be appreciated that movement of the inner elongate member within the passageway may be independent of the rotation of the outer elongate member about the axis $A_2$ (e.g., the inner elongate member may correspondingly rotate with the outer elongate member, but may pivot with respect to the outer elongate member during such rotation).

Figure 5:
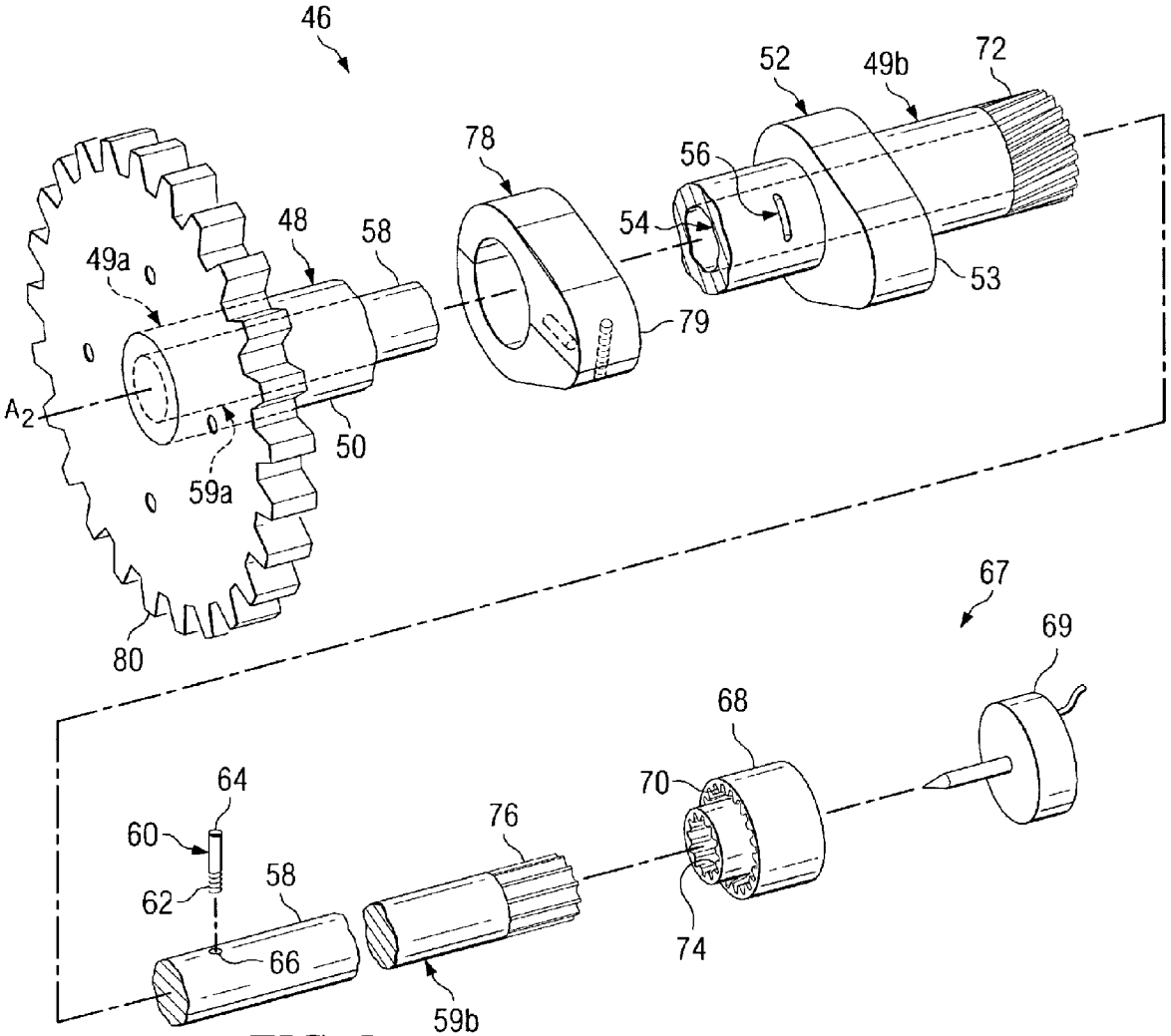
FIG. 5 is an exploded perspective view depicting various components of the camshaft of FIG. 3.

As shown in FIG. 5, the passageway 54 can extend axially throughout the length of the outer elongate member 48 and coaxial with the axis $A_2$. However, in alternative embodiments, the passageway may extend within the outer elongate member in any of a variety of configurations or arrangements. For example, the passageway may extend only partially through the length of the outer elongate member. In another example, the passageway may be parallel with the axis $A_2$, but not coaxial with the axis $A_2$. In yet another example, the passageway may deviate from the axis $A_2$.

As shown in FIGS. 1, 3 and 4, the inner elongate member 58 may be substantially disposed within the passageway 54. In such an embodiment, the second end portion 59*b* of the inner elongate member 58 might not extend beyond the second end portion 49*b* of the outer elongate member 48. However, in alternative embodiments, the inner elongate member may be disposed in the passageway in any of a variety of configurations or arrangements. For example, the inner elongate member might extend from within the passageway (e.g., the first end portion and/or the second end portion of the inner elongate member extend beyond the outer elongate member).

Figure 6:
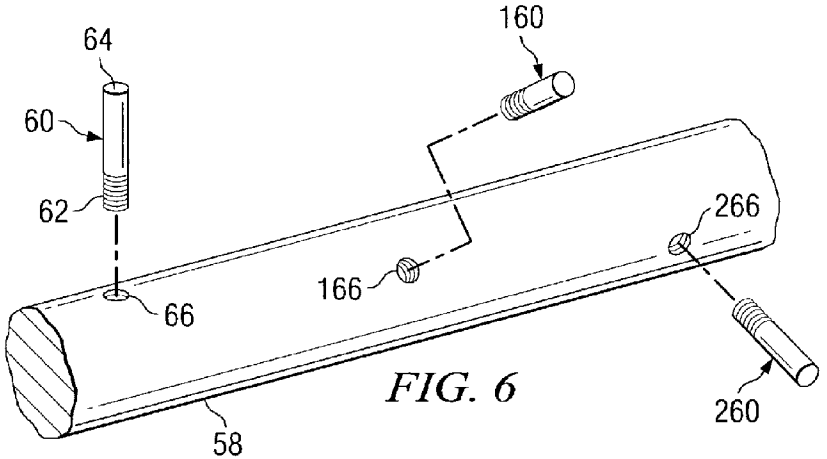
FIG. 6 is a perspective view depicting a portion of an inner elongate member of the camshaft of FIG. 5.
Figure 7:
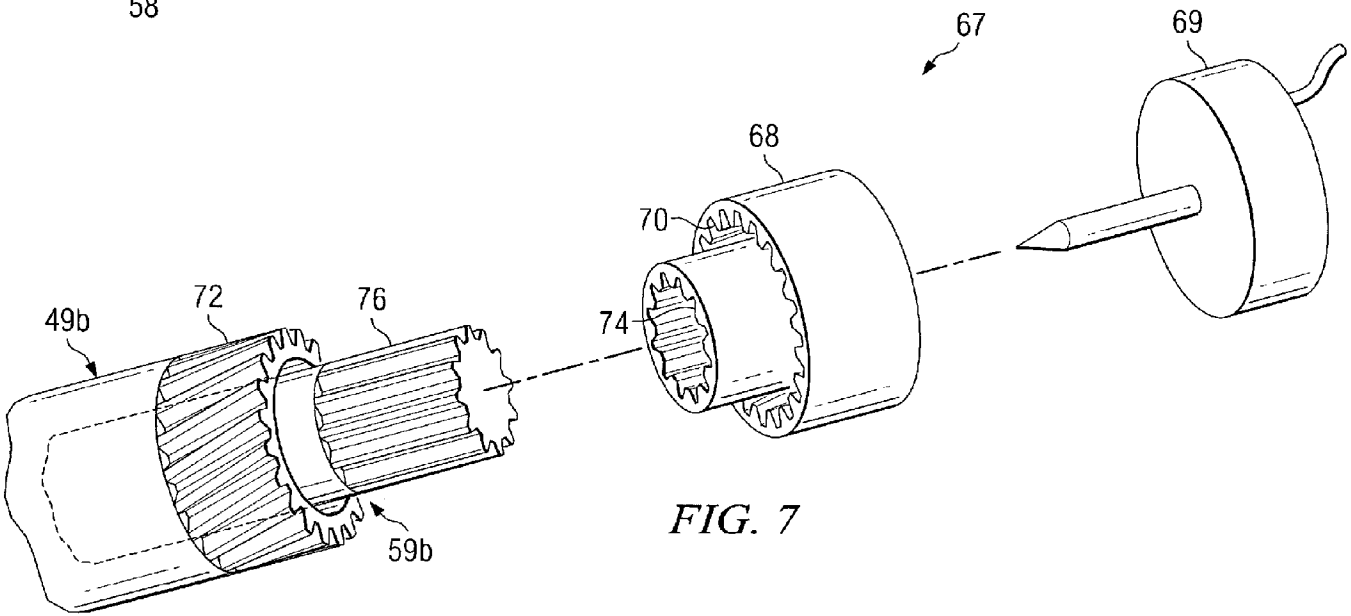
FIG. 7 is an exploded perspective view depicting a camshaft actuator in exploded association with end portions of inner and outer elongate members of the camshaft of FIGS. 1 and 3-5, wherein the inner elongate member is shown to be partially withdrawn from the passageway in the outer elongate member.

As shown in FIGS. 3-4, the outer elongate member 48 may define an aperture 56 extending from an outer surface 50 of the outer elongate member 48 to the passageway 54. The camshaft 46 may comprise a tab 60 attached to the inner elongate member 58 and extending into the aperture 56. In one embodiment, the tab 60 may be threadably attached to the inner elongate member 58. In such an embodiment, the inner elongate member 58 may define a threaded aperture (66 as shown in FIG. 6) which can substantially align with the slotted aperture 56 when the inner elongate member 58 is disposed in the passageway 54. A first end portion 62 of a tab 60 may be threaded into the threaded aperture 66 such that a second end portion 64 of the tab 60 may be provided into the aperture 56. In another embodiment, a first end portion of the a may be welded or otherwise permanently attached onto an inner elongate member. It will be appreciated that a tab may be attached to an inner elongate member in any of a variety of alternative configurations (e.g., snap-fit, frictionally engaged, pinned). It will also be appreciated that a tab may have any of a variety of configurations or arrangements alternative to that depicted in FIG. 6 (e.g., square elongate member, bulbous protrusion).

As shown in FIGS. 1, 3 and 4, the tab 60 may be provided through the aperture 56 such that the second end portion 64 of the tab 60 protrudes from the outer surface 50 of the outer elongate member 48. In alternative embodiments, however, the tab may be provided in any of a variety of alternative configurations or arrangements with respect to an aperture in an outer elongate member. For example, a tab may be provided such that a second end portion of the tab is even with an outer surface of an outer elongate member. In another example, a tab may be provided such that a second end portion of the tab extends below an outer surface of an outer elongate member.

When the inner elongate member 58 is moved, the tab 60 may move with respect to the outer elongate member 48. In one embodiment, and as illustrated in FIGS. 1 and 3-5, the tab 60 may pivot perpendicularly to the axis $A_2$. In another embodiment, a tab may slide along the axis $A_2$. In yet another embodiment, a tab may selectively lengthen with respect to the outer elongate member. It will be appreciated that a tab may move in any of a variety of suitable arrangements. Accordingly, an aperture in an outer elongate member may be configured to permit such movement of the tab 60. In one embodiment, and as illustrated in FIGS. 1 and 3-5, the aperture 56 may comprise a slotted (i.e., elongate) aperture disposed perpendicularly to the axis $A_2$. In another embodiment, the aperture may comprise a slotted aperture disposed parallel with the axis $A_2$. It will be appreciated that such an aperture may have any of a variety of configurations or arrangements to accommodate movement of a tab.

In one embodiment, the first cam 52 may be fixedly attached to one or more other portions of the outer elongate member 48 such that the first cam 52 moves correspondingly with the outer elongate member 48. In this configuration, the second cam 78 can be attached to or otherwise associated with the tab 60 to move correspondingly with the inner elongate member 58. In one embodiment, the second cam 78 may be pivotal with respect to the first cam 52. If the inner elongate member 58 is pivoted with respect to the outer elongate member 48, the second cam 78 may correspondingly pivot with respect to the first cam 52. Through such action, the peak portions 53, 79 of the first and second cams 52, 78 may selectively separate as shown in FIG. 4. It will be appreciated that adjacent cams can be movable with respect to one another in any of a variety of alternative configurations or arrangements.

It will be appreciated that, to facilitate such movement, the second cam 78 may movably contact the outer surface 50 of the outer elongate member 48. In one embodiment, as shown in FIGS. 1, 3 and 4, the second cam 78 may directly contact the outer surface 50 of the outer elongate member 48 in a frictional engagement. In such an embodiment, the second cam 78 may pivot when force provided by the tab 60 overcomes the coefficient of friction between the outer surface 50 and the second cam 78. However, in alternative embodiments, the second cam may be engaged slidably or otherwise with the outer elongate member in any of a variety of configurations or arrangements (e.g., which might involve a bearing provided between the outer surface and the second cam).

Figure 8:
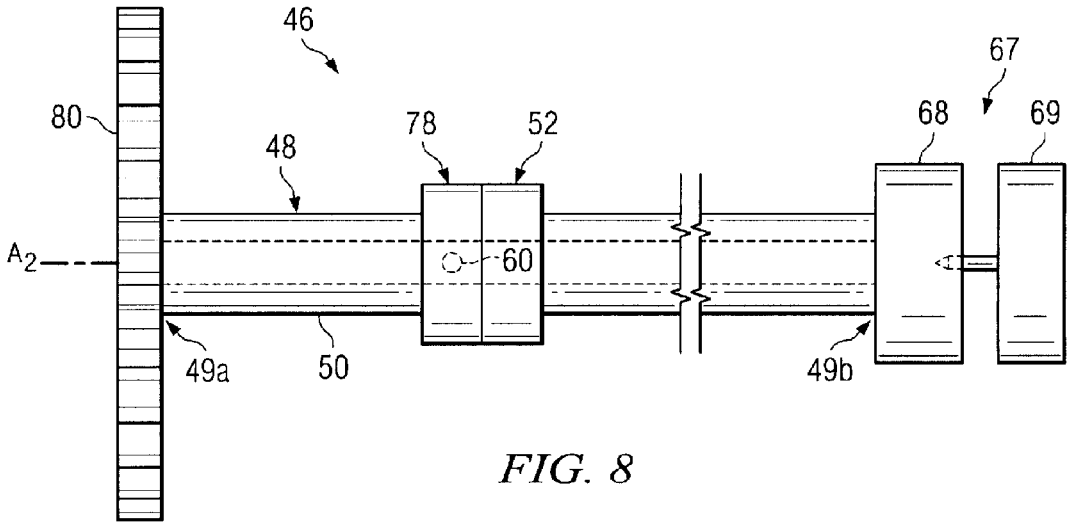
FIG. 8 is a side elevational view depicting the camshaft of FIG. 3.
Figure 9:
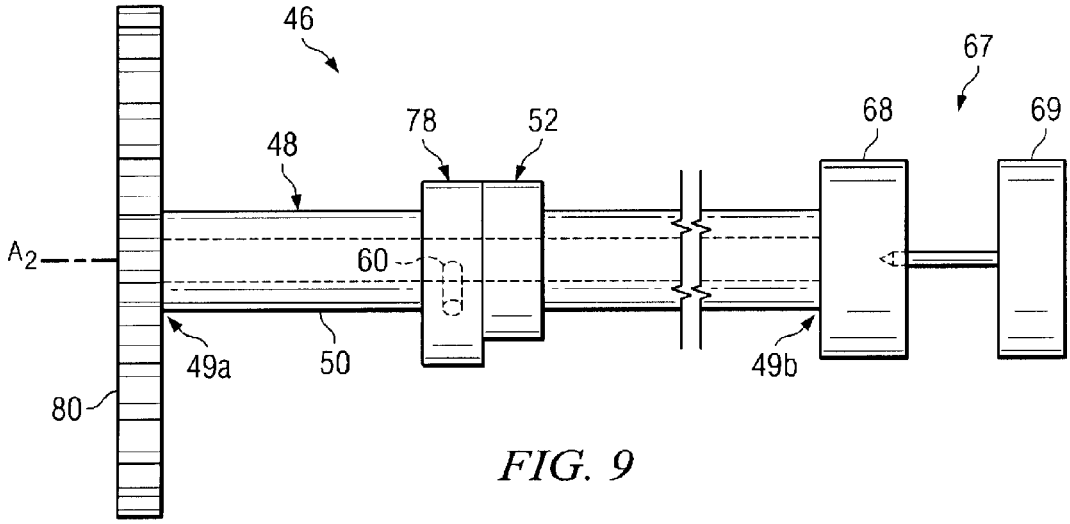
FIG. 9 is a side elevational view depicting the camshaft of FIG. 4.

Movement of the second cam 78 with respect to the first cam 52 may change the valve actuation characteristics resulting from the rotation of the outer elongate member 48. In one embodiment, and as shown in FIGS. 4 and 9, the second cam 78 may be pivoted with respect to the first cam 52 such that the peak portions 53, 79 separate. It will be appreciated that, when the outer elongate member 48 rotates about axis $A_2$, the peak portions 53, 79, when separated as shown in FIGS. 4 and 9, contact the first end portion 40 of the valve 38 for a longer duration than if the peak portions 53, 79 were aligned, as shown in FIGS. 3 and 8. Thus, in this configuration, an extended position of the valve 38 may be maintained for a longer duration thereby prolonging the passage of fluid with respect to the piston chamber 32. In another embodiment in which a peak portion of a second cam is selectively extendable beyond a peak portion of a first cam, extension of the second cam with respect to the first cam may increase the distance that a valve is actuated, thereby facilitating the passage of a greater volume of fluid with respect to a piston chamber. Furthermore, although the tab 60 is shown in FIGS. 1 and 4 to move the second cam 78 to vary the valve actuation characteristics, it will be appreciated that a tab might alternatively be configured to directly contact a first end portion of a valve for varying the valve's actuation characteristics (i.e., without the presence of the second cam).

It will be appreciated that a cam may be provided in any of a variety of suitable configurations or arrangements. In one embodiment, as shown in FIG. 5, the first cam 52 can be provided integrally with one or more other portions of the outer elongate member 48. In an alternative embodiment, the first cam 52 can be attached to one or more other portions of the outer elongate member 48 with adhesives, fasteners, and/or otherwise. As also shown in FIG. 5, the second cam 78 may comprise two separable halves that may be selectively attached together (e.g., with fasteners or adhesives). In another embodiment, the second cam 78 may be formed as a single integral component which can be slid or molded over the outer elongate member 48.

The camshaft 46 may further comprise a camshaft actuator 67 to facilitate selective movement of the inner elongate member 58 relative to the outer elongate member 48. In one embodiment, and as illustrated in FIGS. 1 and 3-5 and 7, the camshaft actuator 67 may comprise a splined member 68 to facilitate selective pivoting of the inner elongate member 58 relative to the outer elongate member 48. The splined member 68 may comprise inner actuator splines 74 and outer actuator splines 70. The inner actuator splines 74 of the splined member 68 may engage corresponding splines (e.g., inner member splines 76) defined by the second end portion 59*b* of the inner elongate member 58. The outer actuator splines 70 of the splined member 68 may engage corresponding splines (e.g., outer member splines 72) defined by the second end portion 49*b* of the outer elongate member 48. As shown in FIG. 5, the inner actuator splines 74 (and corresponding inner member splines 76) may be substantially parallel with the axis $A_2$ while the outer actuator splines 70 (and corresponding inner member splines 76) may be helical with respect to the axis $A_2$. When the outer and inner actuator splines 70, 74 of the splined member 68 are respectively engaged with the outer and inner member splines 72, 76, movement of the splined member 68 along the axis $A_2$ can cause the inner elongate member 58 to pivot with respect to the outer elongate member 48 (see FIGS. 8-9). Therefore, as the inner and outer elongate members 48 and 58 are rotated about the axis $A_2$, the splined member 68 may be moved axially to pivot the inner elongate member 58 with respect to the outer elongate member 48, and thus pivot the tab 60 for changing the valve actuation characteristics as explained above. It will be appreciated that the splined member and splines may be provided in any of a variety of other suitable configurations or arrangements to facilitate selective movement of the inner elongate member with respect to the outer elongate member.

The camshaft actuator 67 may further comprise a driver 69 which is configured to facilitate movement of the splined member 68. In one embodiment and as shown in FIGS. 1, 3-5 and 7-9, the driver 69 may comprise a linear actuator, a portion of which is selectively movable along the axis $A_2$. The linear actuator may contact the splined member 68 such that movement of the linear actuator correspondingly moves the splined member 68. The linear actuator may be affixed adjacent to the splined member 68 such that rotation of the outer elongate member 48 does not correspondingly rotate the linear actuator. Therefore, a rotatable member (e.g., a thrust bearing) may be provided between the linear actuator and the splined member 68 to enable substantially frictionless rotation of the splined member 68 with respect to the linear actuator when the linear actuator contacts the splined member 68. The linear actuator can comprise an electromagnetic plunger-type solenoid, a pneumatic or hydraulic piston, a motor-driven jackshaft, or any of a variety of other suitable configurations for facilitating selective movement of the splined member. It will be appreciated that the camshaft actuator may comprise any of a variety of suitable alternative configurations which can facilitate selective movement of an inner elongate member with respect to an outer elongate member.

It will be appreciated that the camshaft 146 can comprise inner and outer elongate members 148, 158 provided in an arrangement similar to that described above with respect to the camshaft 46. In particular, the outer elongate member 148 can be rotatable about an axis $A_3$ and can have a first cam 152 and a second cam 178 provided adjacent to the valve 138 for directly contacting the valve 138. Moreover, the inner elongate member 158 may be movably disposed within a passageway defined by the outer elongate member 148. An outer surface 150 of the outer elongate member 148 may define an aperture for receiving a tab 360 attached to the inner elongate member 158. It will also be appreciated that a camshaft actuator 167 may be associated with the camshaft 146 in a similar arrangement as described above with respect to the camshaft actuator 67. In particular, the camshaft actuator 167 may comprise a splined member 168 and a driver 169.

To facilitate rotation of an outer elongate member (e.g., 48) about an axis (e.g., $A_2$), a camshaft pulley may be affixed to the outer elongate member such that rotation of the camshaft pulley correspondingly rotates the outer elongate member. A flexible transmitter may be routed sequentially over the camshaft pulley and the crankshaft pulley such that rotation of the crankshaft correspondingly rotates the crankshaft pulley and the camshaft pulley. The flexible transmitter may facilitate a phase relationship between the crankshaft and the camshaft (i.e., particular camshaft rotational positions correspond to particular crankshaft rotational positions).

Figure 2:
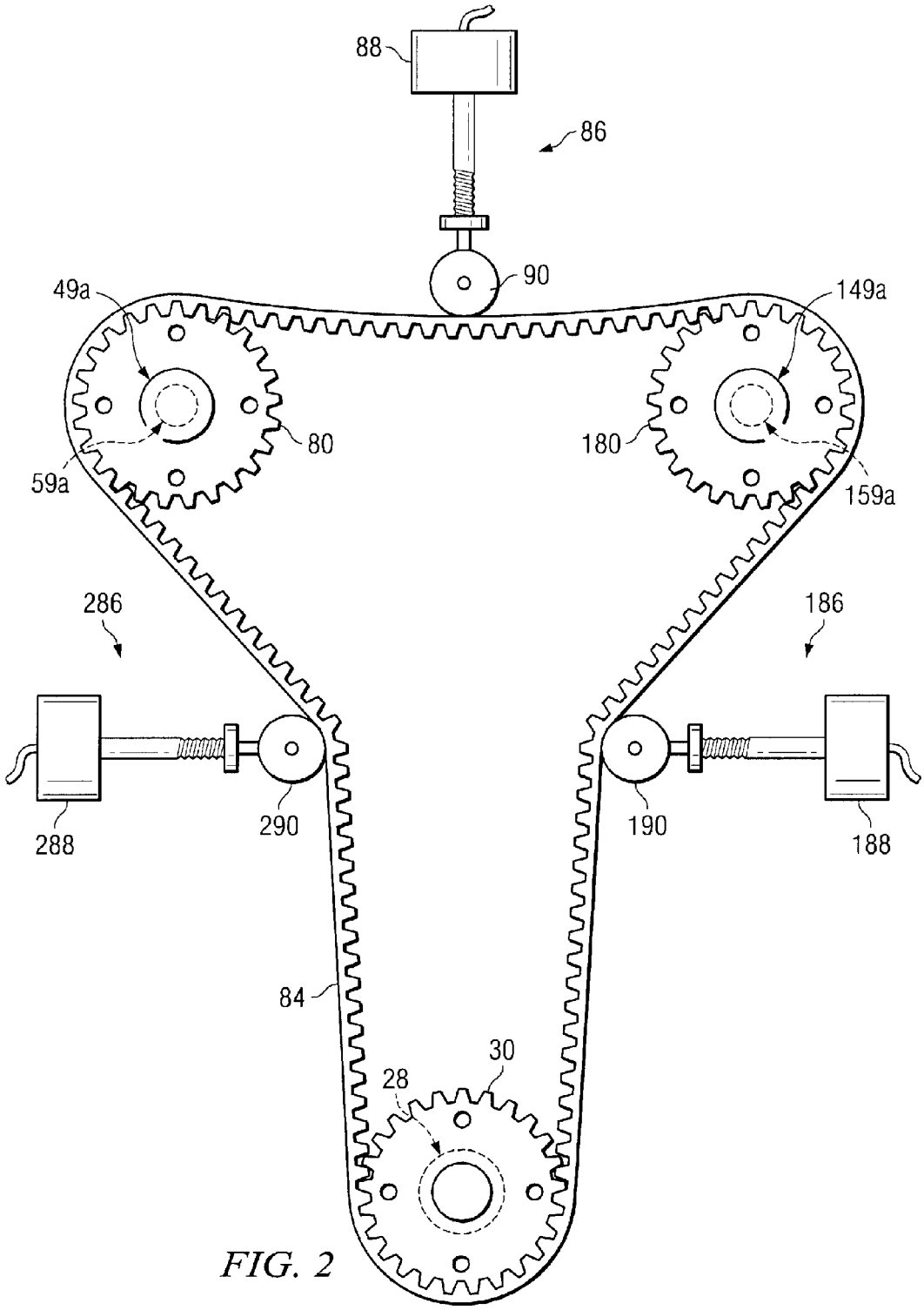
FIG. 2 is a front elevational view depicting certain components of the engine of FIG. 1.

In one embodiment and as illustrated in FIGS. 1-2, camshaft sprockets 80 and 180 may be respectively affixed to the first end portions 49*a* and 149*a* of the outer elongate members 48 and 148. The crankshaft pulley may comprise a corresponding camshaft sprocket 30 affixed to the crankshaft 28. In such an embodiment, a cogged belt 84 may be routed over the camshaft sprockets 80, 180 and the camshaft pulley 30 to facilitate a phase relationship between the camshafts 46, 146, and the crankshaft 28. In another embodiment, the camshaft pulleys and the crankshaft pulley may comprise smooth pulleys, and a V-shaped belt may be routed over the pulleys to facilitate a phase relationship between the camshaft pulleys and the crankshaft pulley. In yet another embodiment, the camshaft pulleys and the crankshaft pulley may comprise sprockets, and a chain may be routed over the pulleys to facilitate a phase relationship between the camshaft pulleys and the crankshaft pulley. It will be appreciated that the flexible transmitter can comprise any of a variety of suitable mechanical arrangements to facilitate a phase relationship between the camshafts and the crankshaft.

It will be appreciated that the engine can include additional camshafts and/or lobes according to various piston arrangements, wherein each of the camshafts and lobes can, in one embodiment, be similar to the camshafts and lobes described above. For example, in a four cylinder engine, each camshaft may comprise four lobes to actuate intake and exhaust valves for each piston cylinder of the four cylinder engine. In another example, in a V-6 engine, four camshafts may be provided (e.g., two camshafts for each bank of three cylinders), wherein each of the four camshafts comprises three lobes to actuate intake and exhaust valves for each piston cylinder for a given bank. It will also be appreciated that the camshafts can include additional tabs according to the lobe arrangements. For example, and as illustrated in FIG. 6, three tabs 60, 160 and 260 may be respectively disposed within three threaded tab apertures 66, 166 and 266 defined by the inner elongate member 58 to engage three movable cams in association with the outer elongate member 48.

FIG. 1 depicts an engine having a dual over-head cam arrangement (e.g., two camshafts per bank of piston cylinders). However, it will be appreciated that any number of camshafts may be provided for each bank of piston cylinders of an engine. For example, in one alternative embodiment, an engine may comprise a single camshaft per bank of cylinders (i.e., a single over-head cam arrangement). The single camshaft may contact and control the valve(s) associated with each piston cylinder in the bank. In such an embodiment, a flexible transmitter may be routed over a camshaft pulley attached to the first end of the outer elongate member and over a crankshaft pulley.

Referring again to FIGS. 1-2, the engine 24 can comprise deflection members 86, 186 and 286 arranged adjacent to the flexible transmitter (e.g., 84) such that the flexible transmitter may be routed over the camshaft pulley(s), the crankshaft pulley, and the deflection members 86, 186 and 286. The deflection members 86, 186 and 286 can each comprise an engagement portion for contacting the flexible transmitter. In one embodiment, the deflection members 86, 186 and 286 may comprise idler pulleys 90, 190 and 290. The idler pulleys 90, 190 and 290 may rotatably engage the flexible transmitter such that movement of the flexible transmitter (i.e., during rotation of the crankshaft pulley and corresponding camshaft pulleys) correspondingly rotates the idler pulleys 90, 190 and 290 about respective axes $A_4$, $A_5$, and $A_6$ (shown in FIG. 1). In another embodiment, the deflection members may comprise tensioners. In such an embodiment, the tensioners may comprise a smooth surface which may contact the flexible transmitter during movement of the flexible transmitter.

The deflection members 86, 186, and 286 may be respectively disposed between the camshaft sprockets 80, 180, and the crankshaft sprocket 30 (as shown in FIG. 1). The deflection members 86, 186, and 286 can selectively bias the cogged belt 84 to provide tension on the cogged belt 84 and maintain engagement of the cogged belt 84 with the camshaft sprockets 80, 180, and the crankshaft sprocket 30. It will be appreciated that the deflection members may be provided in any of a variety of configurations or arrangements to bias the flexible transmitter with respect to the pulleys.

The positioning of the deflection members with respect to the flexible transmitter may affect the phase relationship between the camshaft(s) and the crankshaft. The position of the deflection members may be maintained to provide and maintain a phase relationship. The deflection members, however, may be selectively moved to adjust the relative distance between the deflector members and the crankshaft and thereby adjust the phase relationship. Such selective movement of the deflection members may facilitate variation in the phase relationship between the camshafts and crankshaft.

In one embodiment, the deflection members 86, 186, and 286 may move to adjust the relative distance between the axis $A_1$ and the axes $A_4$, $A_5$ and $A_6$. In such an embodiment, the cogged belt 84 may be substantially inelastic and the deflection members 86, 186, and 286 may operate together to effectuate variation in the phase relationship between the camshafts 46, 146, and the crankshaft 28. For example, the deflection member 86 may move the idler pulley 90 and the deflection member 186 may move the idler pulley 190 which together can result in rotation of the camshaft 146 with respect to the crankshaft 28 and resultant variation in the phase relationship between the camshaft 146 and the crankshaft 28. In another example, the deflection member 186 may move the idler pulley 190 and the deflection member 286 may move the idler pulley 290 which together can result in rotation of the camshafts 46, 146 with respect to the crankshaft 28 and resultant variation in the phase relationship between the camshafts 46, 146 and the crankshaft 28. In yet another example, the deflection member 86 may move the idler pulley 90 and the deflection member 286 may move the idler pulley 290 which together can result in rotation of the camshaft 46 with respect to the crankshaft 28 and resultant variation in the phase relationship between the camshaft 46 and the crankshaft 28. In an additional example, each deflection member 86, 186, and 286 may move the idler pulleys 90, 190, and 290 in conjunction which together can result in rotation of the camshafts 46, 146 with respect to each other and the crankshaft 28 and resultant variation in the phase relationship between camshafts 46, 146, and the crankshaft 28. It will be appreciated that the deflection members may comprise any of a variety of mechanical arrangements or configurations to facilitate variation of the phase relationship between the crankshaft and one or more camshafts. It will also be appreciated that any number of deflection members may be implemented (e.g., two deflection members for a single overhead cam system) and that an associated flexible transmitter may be routed accordingly (e.g., routed over the camshaft pulley, two deflection members, and the crankshaft pulley in a single overhead cam arrangement).

The engine may comprise one or more deflection actuators engaged with the deflection members to facilitate movement of the deflection members and to accordingly facilitate variation in the phase relationship. In one embodiment, and as shown in FIGS. 1 and 2, each deflection member 86, 186, and 286 is shown to comprise a respective deflection actuator 88, 188, 288. Although each of the respective deflection actuators 88, 188, 288 is shown to comprise a motor-driven jackscrew, it will be appreciated that any of a variety of alternative mechanical arrangements or configurations can be provided to facilitate movement of deflection members. It will also be appreciated that any number of deflection actuators may be provided for actuating any number of deflection members. For example, in one alternative embodiment, one deflection actuator can be provided for selectively moving multiple deflection members.

It will be appreciated that the adjustable camshaft and deflection members may facilitate adjustment of valve actuation characteristics and timing of valve actuation. Such adjustment may be made statically to impart a particular engine operation (e.g., rich fuel-air mixture) for the life of the engine. Such adjustment may also be made dynamically to improve engine operation based on different driving conditions experienced during vehicle operation (e.g., increase the duration of the extended position of the valves at high vehicle speeds). In any adjustment scenario, the adjustment may be made by an operator, an on-vehicle computer (e.g., an Engine Control Unit or ECU), or any of a variety of control arrangements.

It will be appreciated that selectively controlling the characteristics of the valves along with the phase relationship between camshafts and crankshaft in an engine may provide benefits over conventional engine arrangements. The valve characteristics may affect the performance of an engine by controlling the combustion of fluid in each piston cylinder (i.e., fuel/air ratio, the duration of intake and/or the duration of exhaust). The phase relationship between camshafts and crankshafts may affect the performance of an engine by controlling the position of the pistons during the combustion of fluid in each piston cylinder (i.e., the timing). However, changing either the valve characteristics or the timing may affect the performance of the engine differently. For instance, changing the valve characteristics may increase the fuel efficiency while decreasing the horsepower. Changing the timing may increase horsepower while decreasing fuel efficiency. Therefore, by controlling the valve characteristics along with the timing, ideal engine performance may be achieved. It will also be appreciated that, if a camshaft driver (e.g., 69) fails during the operation of the engine, the deflection actuators might be controllable to facilitate continued operation of the engine at acceptable performance levels. Conversely, if one or more of an engine's deflection actuators fail during the operation of the engine, the engine's camshafts might be adjustable to facilitate continued operation of the engine at acceptable performance levels.

The foregoing description of embodiments and examples has been presented for purposes of illustration and description. It is not intended to be exhaustive or to limit the invention to the forms described. Numerous modifications are possible in light of the above teachings. Some of those modifications have been discussed, and others will be understood by those skilled in the art. The embodiments were chosen and described in order to best illustrate various embodiments as are suited to the particular use contemplated. It is hereby intended that the scope of the invention be defined by the claims appended hereto.

What is claimed is:

1. An engine comprising:

a crankshaft;

a crankshaft pulley attached to the crankshaft and configured to rotate about a crankshaft axis;

a piston cylinder;

a piston attached to the crankshaft and disposed at least partially within the piston cylinder;

a valve configured for selectively facilitating passage of fluid with respect to the piston cylinder;

a camshaft comprising:

an outer elongate member comprising an outer surface and a lobe, the lobe configured for actuating the valve, the outer elongate member axially defining a passageway and defining an aperture extending from the outer surface to the passageway, wherein the outer elongate member is configured to rotate about a first axis;

an inner elongate member axially disposed within the passageway and configured to move within the passageway;

a tab attached to the inner elongate member and extending into the aperture defined by the outer elongate member; and a camshaft actuator configured to selectively move the inner elongate member relative to the outer elongate member;

a camshaft pulley attached to the camshaft and configured to rotate about the first axis;

a first deflection member;

a second deflection member;

a flexible transmitter routed sequentially over the camshaft pulley, the first deflection member, the crankshaft pulley and the second deflection member such that rotation of the crankshaft correspondingly rotates the camshaft pulley to facilitate a phase relationship between the camshaft pulley and the crankshaft pulley; and a first deflection actuator engaged with the first deflection member and configured to selectively adjust the relative distance between the first deflection member and the crankshaft axis to facilitate variation in the phase relationship.

2. The engine of claim 1 wherein the inner elongate member is configured to pivot about the first axis with respect to the outer elongate member.

3. The engine of claim 2 wherein the camshaft actuator is configured to selectively pivot the inner elongate member relative to the outer elongate member.

4. The engine of claim 1 wherein the camshaft actuator comprises splines, at least some of which are configured to engage corresponding splines on the outer elongate member and at least others of which are configured to engage corresponding splines on the inner elongate member.

5. The engine of claim 1 further comprising a second lobe contacting the outer surface, wherein the second lobe engages the tab and is configured to move correspondingly with the inner elongate member.

6. The engine of claim 1 wherein the tab is configured to extend through the aperture defined by the outer elongate member.

7. The engine of claim 1 wherein the first deflection member comprises a first idler pulley having a first idler axis and wherein the first deflection actuator is configured to adjust the relative distance between the first idler axis and the crankshaft axis to facilitate variation in the phase relationship.

8. The engine of claim 1 further comprising a second deflection actuator engaged with the second deflection member and configured to selectively adjust the relative distance between the second deflection member and the crankshaft axis to facilitate variation in the phase relationship.

9. The engine of claim 8 wherein the first deflection member comprises a first idler pulley having a first idler axis, the first deflection actuator is configured to adjust the relative distance between the first idler axis and the crankshaft axis to facilitate variation in the phase relationship, the second deflection member comprises a second idler pulley having a second idler axis, and the second deflection actuator is configured to adjust the relative distance between the second idler axis and the crankshaft axis to facilitate variation in the phase relationship.

10. The engine of claim 1 wherein the flexible transmitter comprises one of a belt and a chain.

11. An engine comprising:

a crankshaft;

a crankshaft pulley attached to the crankshaft and configured to rotate about a crankshaft axis;

at least one piston cylinder;

at least one piston attached to the crankshaft and disposed at least partially within the piston cylinder;

a plurality of valves configured for selectively facilitating passage of fluid with respect to said piston cylinder;

a first camshaft comprising:

a first outer elongate member comprising a first outer surface and a first lobe, the first lobe configured for actuating one of said valves, the first outer elongate member axially defining a first passageway and defining a first aperture extending from the first outer surface to the first passageway, wherein the first outer elongate member is configured to rotate about a first axis;

a first inner elongate member axially disposed within the first passageway and configured to move within the first passageway;

a first tab attached to the first inner elongate member and extending into the first aperture defined by the first outer elongate member; and a first camshaft actuator configured to selectively move the first inner elongate member relative to the first outer elongate member;

a second camshaft comprising:

a second outer elongate member comprising a second outer surface and a second lobe, the second lobe configured for actuating another of said valves, the second outer elongate member axially defining a second passageway and defining a second aperture extending from the second outer surface to the second passageway, wherein the second outer elongate member is configured to rotate about a second axis;

a second inner elongate member axially disposed within the second passageway and configured to move within the second passageway;

a second tab attached to the second inner elongate member and extending into the second aperture defined by the second outer elongate member; and a second camshaft actuator configured to selectively move the second inner elongate member relative to the second outer elongate member;

a first camshaft pulley attached to the first camshaft and configured to rotate about the first axis;

a second camshaft pulley attached to the second camshaft and configured to rotate about the second axis;

a first deflection member;

a second deflection member;

a flexible transmitter routed over the first camshaft pulley, the second camshaft pulley, the first deflection member, the second deflection member, and the crankshaft pulley such that rotation of the crankshaft correspondingly rotates the first camshaft pulley and the second camshaft pulley to facilitate a phase relationship between each of the first camshaft pulley, the second camshaft pulley and the crankshaft pulley; and a first deflection actuator engaged with the first deflection member and configured to selectively adjust the relative distance between the first deflection member and the crankshaft axis to facilitate variation in the phase relationship between at least two of the first camshaft pulley, the second camshaft pulley and the crankshaft pulley.

12. The engine of claim 11 wherein the flexible transmitter is routed sequentially over the first deflection member, the first camshaft pulley, the second deflection member, the second camshaft pulley, and the crankshaft pulley.

13. The engine of claim 11 further comprising a second actuator engaged with the second deflection member and configured to selectively adjust the distance between the second deflection member and the crankshaft axis to facilitate variation in the phase relationship between at least two of the first camshaft pulley, the second camshaft pulley and the crankshaft pulley.

14. The engine of claim 11 further comprising:

a third lobe contacting the first outer surface, wherein the third lobe engages the first tab and is configured to move correspondingly with the first inner elongate member;

a fourth lobe contacting the second outer surface, wherein the fourth lobe engages the second tab and is configured to move correspondingly with the second inner elongate member.

15. The engine of claim 11 further comprising a third deflection member.

16. The engine of claim 15 further comprising:

a second actuator engaged with the second deflection member and configured to selectively adjust the distance between the second deflection member and the crankshaft axis to facilitate variation in the phase relationship between at least two of the first camshaft pulley, the second camshaft pulley and the crankshaft pulley; and a third actuator engaged with the third deflection member and configured to selectively adjust the distance between the third deflection member and the crankshaft axis to facilitate variation in the phase relationship between at least two of the first camshaft pulley, the second camshaft pulley and the crankshaft pulley.

17. The engine of claim 16 wherein the first deflection member comprises a first idler pulley having a first idler axis, the first deflection actuator is configured to adjust the relative distance between the first idler axis and the crankshaft axis to facilitate variation in the phase relationship between at least two of the first camshaft pulley, the second camshaft pulley and the crankshaft pulley, the second deflection member comprises a second idler pulley having a second idler axis, the second deflection actuator is configured to adjust the relative distance between the second idler axis and the crankshaft axis to facilitate variation in the phase relationship between at least two of the first camshaft pulley, the second camshaft pulley and the crankshaft pulley, the third deflection member comprises a third idler pulley having a third idler axis, and the third deflection actuator is configured to adjust the relative distance between the third idler axis and the crankshaft axis to facilitate variation in the phase relationship between at least two of the first camshaft pulley, the second camshaft pulley and the crankshaft pulley.

18. A vehicle comprising:

a drivetrain; and an engine coupled to the drivetrain, the engine comprising:

a crankshaft;

a crankshaft pulley attached to the crankshaft and configured to rotate about a crankshaft axis;

a piston cylinder;

a piston attached to the crankshaft and disposed at least partially within the piston cylinder;

a valve configured for selectively facilitating passage of fluid with respect to the piston cylinder;

a camshaft comprising:

an outer elongate member comprising an outer surface and a lobe, the lobe configured for actuating the valve, the outer elongate member axially defining a passageway and defining an aperture extending from the outer surface to the passageway, wherein the outer elongate member is configured to rotate about a first axis;

an inner elongate member axially disposed within the passageway and configured to move within the passageway;

a tab attached to the inner elongate member and extending into the aperture defined by the outer elongate member; and a camshaft actuator configured to selectively move the inner elongate member relative to the outer elongate member;

a camshaft pulley attached to the camshaft and configured to rotate about the first axis;

a first deflection member;

a second deflection member;

a flexible transmitter routed sequentially over the camshaft pulley, the first deflection member, the crankshaft pulley and the second deflection member such that rotation of the crankshaft correspondingly rotates the camshaft pulley to facilitate a phase relationship between the camshaft pulley and the crankshaft pulley; and a first deflection actuator engaged with the first deflection member and configured to selectively adjust the relative distance between the first deflection member and the crankshaft axis to facilitate variation in the phase relationship.

19. The vehicle of claim 18 wherein the engine further comprises a second lobe contacting the outer surface, wherein the second lobe engages the tab and is configured to move correspondingly with the inner elongate member.

20. The vehicle of claim 18 wherein the first deflection member comprises a first idler pulley having a first idler axis and wherein the first deflection actuator is configured to adjust the relative distance between the first idler axis and the crankshaft axis to facilitate variation in the phase relationship.

21. The vehicle of claim 18 wherein the engine further comprises a second deflection actuator engaged with the second deflection member and configured to selectively adjust the relative distance between the second deflection member and the crankshaft axis to facilitate variation in the phase relationship.

22. The vehicle of claim 21 wherein the first deflection member comprises a first idler pulley having a first idler axis, the first deflection actuator is configured to adjust the relative distance between the first idler axis and the crankshaft axis to facilitate variation in the phase relationship, the second deflection member comprises a second idler pulley having a second idler axis, and the second deflection actuator is configured to adjust the relative distance between the second idler axis and the crankshaft axis to facilitate variation in the phase relationship.

23. A vehicle comprising:

a drivetrain; and an engine coupled with the drivetrain, the engine comprising:

a crankshaft;

a crankshaft pulley attached to the crankshaft and configured to rotate about a crankshaft axis;

at least one piston cylinder;

at least one piston attached to the crankshaft and disposed at least partially within the piston cylinder;

a plurality of valves configured for selectively facilitating passage of fluid with respect to said piston cylinder;

a first camshaft comprising:

a first outer elongate member comprising a first outer surface and a first lobe, the first lobe configured for actuating one of said valves, the first outer elongate member axially defining a first passageway and defining a first aperture extending from the first outer surface to the first passageway, wherein the first outer elongate member is configured to rotate about a first axis;

a first inner elongate member axially disposed within the first passageway and configured to move within the first passageway;

a first tab attached to the first inner elongate member and extending into the first aperture defined by the first outer elongate member; and a first camshaft actuator configured to selectively move the first inner elongate member relative to the first outer elongate member;

a second camshaft comprising:

a second outer elongate member comprising a second outer surface and a second lobe, the second lobe configured for actuating another of said valves, the second outer elongate member axially defining a second passageway and defining a second aperture extending from the second outer surface to the second passageway, wherein the second outer elongate member is configured to rotate about a second axis;

a second inner elongate member axially disposed within the second passageway and configured to move within the second passageway;

a second tab attached to the second inner elongate member and extending into the second aperture defined by the second outer elongate member; and a second camshaft actuator configured to selectively move the second inner elongate member relative to the second outer elongate member;

a first camshaft pulley attached to the first camshaft and configured to rotate about the first axis;

a second camshaft pulley attached to the second camshaft and configured to rotate about the second axis;

a first deflection member;

a second deflection member;

a flexible transmitter routed over the first camshaft pulley, the second camshaft pulley, the first deflection member, the second deflection member, and the crankshaft pulley such that rotation of the crankshaft correspondingly rotates the first camshaft pulley and the second camshaft pulley to facilitate a phase relationship between each of the first camshaft pulley, the second camshaft pulley and the crankshaft pulley; and a first deflection actuator engaged with the first deflection member and configured to selectively adjust the relative distance between the first deflection member and the crankshaft axis to facilitate variation in the phase relationship between at least two of the first camshaft pulley, the second camshaft pulley and the crankshaft pulley.

24. The vehicle of claim 23 wherein the flexible transmitter is routed sequentially over the first deflection member, the first camshaft pulley, the second deflection member, the second camshaft pulley, and the crankshaft pulley.

25. The vehicle of claim 23 wherein the engine further comprises a second actuator engaged with the second deflection member and configured to selectively adjust the distance between the second deflection member and the crankshaft axis to facilitate variation in the phase relationship between at least two of the first camshaft pulley, the second camshaft pulley and the crankshaft pulley.

26. The vehicle of claim 23 wherein the engine further comprises:

a third lobe contacting the first outer surface, wherein the third lobe engages the first tab and is configured to move correspondingly with the first inner elongate member;

a fourth lobe contacting the second outer surface, wherein the fourth lobe engages the second tab and is configured to move correspondingly with the second inner elongate member.

27. The vehicle of claim 23 wherein the engine further comprises a third deflection member.

28. The vehicle of claim 27 wherein the engine further comprises:

a second actuator engaged with the second deflection member and configured to selectively adjust the distance between the second deflection member and the crankshaft axis to facilitate variation in the phase relationship between at least two of the first camshaft pulley, the second camshaft pulley and the crankshaft pulley; and a third actuator engaged with the third deflection member and configured to selectively adjust the distance between the third deflection member and the crankshaft axis to facilitate variation in the phase relationship between at least two of the first camshaft pulley, the second camshaft pulley and the crankshaft pulley.

29. The vehicle of claim 28 wherein the first deflection member comprises a first idler pulley having a first idler axis, the first deflection actuator is configured to adjust the relative distance between the first idler axis and the crankshaft axis to facilitate variation in the phase relationship between at least two of the first camshaft pulley, the second camshaft pulley and the crankshaft pulley, the second deflection member comprises a second idler pulley having a second idler axis, the second deflection actuator is configured to adjust the relative distance between the second idler axis and the crankshaft axis to facilitate variation in the phase relationship between at least two of the first camshaft pulley, the second camshaft pulley and the crankshaft pulley, the third deflection member comprises a third idler pulley having a third idler axis, and the third deflection actuator is configured to adjust the relative distance between the third idler axis and the crankshaft axis to facilitate variation in the phase relationship.

* * * * *